United States Patent [19]

Roccaforte et al.

[11] 4,298,123

[45] Nov. 3, 1981

[54] CARTON CORE RETAINERS

[75] Inventors: Harry I. Roccaforte, Western Springs, Ill.; Jimmy J. Hanko, Racine, Wis.

[73] Assignee: Champion International Corporation, Stamford, Conn.

[21] Appl. No.: 116,857

[22] Filed: Jan. 30, 1980

[51] Int. Cl.[3] ..... B65D 85/67; B65D 85/671; B65D 5/50

[52] U.S. Cl. ..... 206/396

[58] Field of Search ..... 206/396, 395, 397

[56] References Cited

U.S. PATENT DOCUMENTS 2,743,009 4/1956 Williamson et al. ..... 206/396

2,935,192 3/1960 Million-Czarnecki ..... 206/396

3,246,742 4/1966 Coe ..... 206/396

*Primary Examiner*—William T. Dixson, Jr.

*Attorney, Agent, or Firm*—Evelyn M. Sommer

[57] ABSTRACT

A carton having at least three sides for containing a product on a hollow core and having end walls at least one of which forms a core retainer comprising an inner wall coupled to a first side of said carton and having an orifice therein, an overlapping wall coupled to a second side of said carton and having a projection thereon extending through said orifice into said hollow core whereby said core is held in said carton and an outer wall coupled to a third side of said carton for closing the end of said carton.

15 Claims, 8 Drawing Figures

CARTON CORE RETAINERS

BACKGROUND OF THE INVENTION

Many modern day cartons contain products such as fabric softeners, waxed paper, aluminum foil, film wraps and the like which are in a roll formed around a hollow core. This rolled product is packaged in a carton so it can be dispensed as needed. The product is dispensed by opening the carton and either cutting the material at one edge of the carton on a metal edge cutter or tearing the product from the roll at pre-determined sections that are perforated. As the product is unrolled during the dispensing operation, the entire roll may come out of the box. It is inconvenient to have to replace the roll in the box practically every time it is used.

SUMMARY OF THE INVENTION

The present invention overcomes the problems of the prior art wherein the entire product roll may come out of the box each time it is desired to dispense a portion thereof and it offers the convenience of retaining the roll inside the box at all times including those times when the product is being dispensed. Core retainers are formed at each end of the box which project inside the core as the carton is erected. The retainers are projections integrally formed with the blank for forming the carton which projections are inserted inside the ends of the hollow core as the carton is erected. Thus, as any pressure is applied to the product core which tends to pull or otherwise remove it from the carton, as for instance by dispensing the product from the roll, the projections retain the core within the carton.

Thus the present invention relates to a carton having at least three sides for containing a product on a hollow core and at least one carton end wall forming a core retainer comprising an inner wall coupled to a first side of said carton and having an orifice therein, an overlapping wall coupled to a second side of said carton and having a projection thereon extending through said orifice into said hollow core whereby said core is held in said carton and an outer wall coupled to a third side of said carton for closing the end of said carton.

The invention also relates to a carton blank for forming a carton having a core retainer therein comprising top, bottom, front and back side panels integrally formed with and hingedly attached to each other, an inner wall having an orifice therein and hingedly connected to each end of one of said side panels, an overlapping wall having a projection thereon and hingedly connected to each end of a second one of said side panels and an outer wall connected to each end of a third one of said side panels whereby when said blank is tubed, folded and erected with a product on a hollow core contained therein, said inner wall, overlapping wall and outer wall on each end form an end wall of said carton with said projection retaining said core in said carton.

BRIEF DESCRIPTION OF THE DRAWINGS

These and other objects and advantages of the present invention will be disclosed in the course of the following specification, reference being had to the accompanying drawings in which.

DESCRIPTION OF THE PREFERRED EMBODIMENT

Where products such as fabric softeners, waxed paper, aluminum foil, film wraps and the like are formed in a roll around a hollow core, it would be advantageous to have some means for preventing the core with the product thereon from coming out of the box each time it is desired to dispense the product from the roll. Some of the prior art cartons have metal edge cutters on one edge of the carton and the product is unrolled to the extent needed and then cut on the metal edge cutter. Alternately, it may be unrolled until a pre-determined perforated section is reached and then the product is torn loose at the perforations.

However, each time the product is unrolled or a section is attempted to be removed, the entire roll attempts to come out of the box. It would be convenient if some type of projection were inserted into the hollow core of the product roll and attached to the carton itself to prevent the roll from coming out of the box each time the product is unrolled. The present invention overcomes the disadvantages of the prior art by providing a projection integrally formed with the carton blank such that when the blank is folded to form the carton, a projection exists which may be inserted inside the hollow core of the product roll and thus prevent the roll from being removed inadvertently from the carton by dispensing or unrolling product from the product roll.

Figure 1:
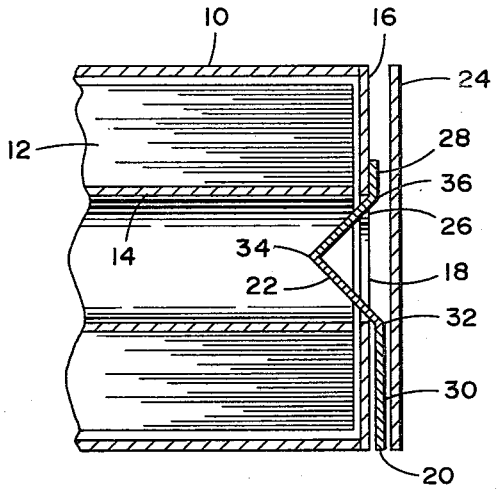
FIG. 1 is a partial view of the novel carton showing a cross section of the product on the hollow core and the construction of the end wall which has a projection thereon for retaining said hollow core in said carton.

The construction of a novel carton end wall for providing such a projection to prevent the product roll from being removed from the carton is disclosed in FIG. 1 which is a partial cross sectional view of a carton illustrating the novel end wall construction used to retain the product core within the carton. Thus as disclosed in FIG. 1, carton 10 has therein product roll 12 which is formed or rolled on hollow core 14. The end wall construction of carton 10 comprises an inner wall 16 having an orifice 18 therein, an overlapping wall 20 having a projection 22 thereon and an outer wall 24 for sealing the end of the carton. Inner wall 16 has a detent 26 in said orifice 18 in which a locking tab 28 of projection 22 may be inserted to hold projection 22 in place inside hollow core 14. Projection 22 comprises a panel 30 to which projection 22 is hingedly coupled at score line 32, a fold line 34 in said projection 22 allowing said projection to bend about said fold line 34 and form a V-shaped insert pointedly extending into said hollow core 14 and locking tab 28 hingedly connected at score line 36 to the outer end of said projection 22 for engaging said slotted detent 26 in said orifice 18 in inner wall 16 thereby locking said V-shaped insert within said hollow core. As can be seen in FIG. 1, if any pressure is applied to product roll 12 and its associated hollow core 14 such as by attempting to dispense product from roll 12, projection 22, inserted within hollow core 14, tends to retain core 14 within the carton and prevent it from being removed by external forces tending to dispense product from the roll. The manner in which inner wall 16, overlapping wall 20 and outer wall 24 are attached to the carton sides will be shown hereinafter.

Figure 2:
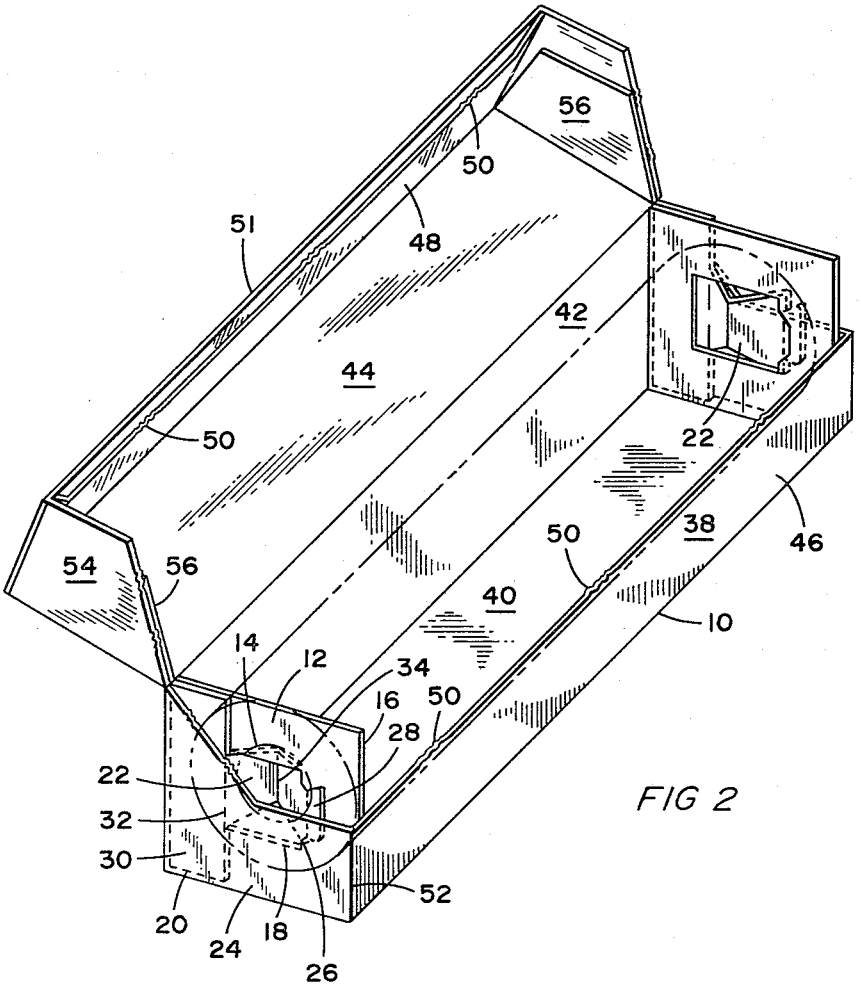
FIG. 2 is a perspective view of one embodiment of a carton of the present invention showing the carton in its opened state with a product roll on a hollow core therein and illustrating the construction of the end walls for retaining said product and hollow core within said carton.

FIG. 2 is a perspective view of a carton in its opened state and having therein a product roll wherein the construction of the end walls is illustrated. Thus carton 10 has a front side 38, bottom side 40, back side 42, and top side 44. Product 12 is rolled on core 14 and is shown in phantom lines inside carton 10.

The end construction of carton 10 can be plainly seen in FIG. 2. Inner wall 16 is illustrated with orifice 18 and detent 26 therein. Overlapping wall 20 is formed with panel 30 hingedly attached to projection 22 at score line 32. Projection 22 is folded about score line 34 to form a V-shaped insert pointedly extending into hollow core 14. The remaining end of projection 22 includes a locking tab 28 which is inserted in detent 26 of inner wall 16 to lock projection 22 in the position shown. Thus, on each end of carton 10, a V-shaped projection 22 is inserted inside core 14 thus holding core 14 within carton 10. Outer wall 24 is superimposed over and is in an abutting relationship with overlapping wall 20 and projection 22 to assist in maintaining projection 22 through inner wall 16 inside product core 14.

Front side 38 is actually formed of two sections, 46 and 48, which are joined by tear perforations 50. The portion 48 is glued to a panel extension 51 which is integrally formed with and hingedly attached to top side 44. When pressure is applied to the perforations 50, they separate and allow the portion 48 of front side 38 to be carried with extension 51 and top side 44, thus opening the carton.

In the particular embodiment shown in FIG. 2, outer wall 24 is hingedly attached to front side 38 by hinge line 52. The tear line with tear perforations 50 thus extends not only across front side 38 but also across outer wall 24 thus allowing top side 44 to carry with it a portion 54 of outer wall 24.

Figure 3:
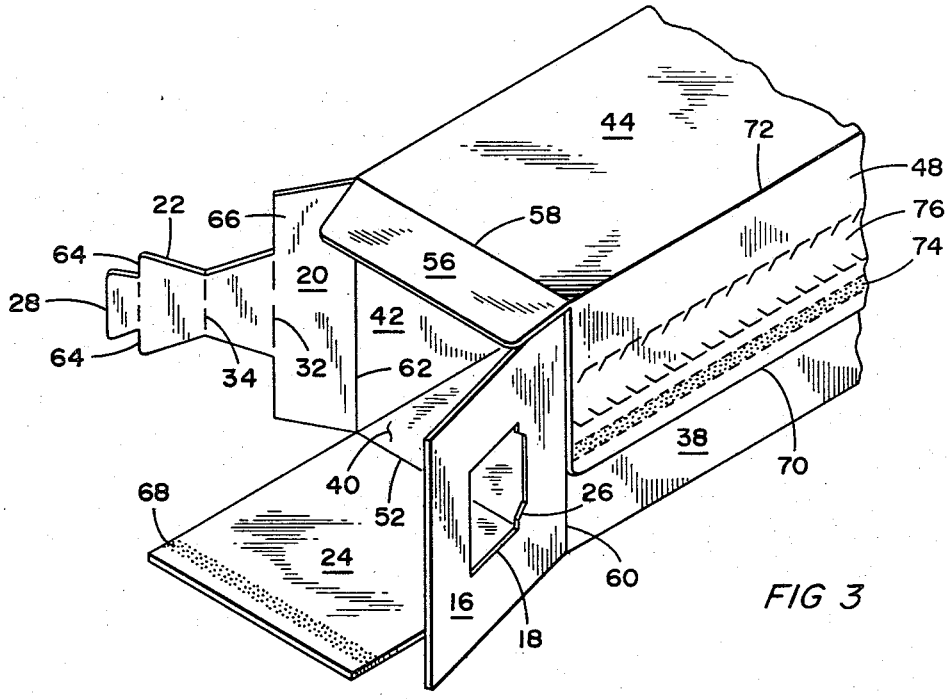
FIG. 3 is a perspective view of one end of a preferred embodiment of the carton of the present invention illustrating the relationship of the walls forming the end thereof.

FIG. 3 is a partial perspective end view of one embodiment of the present invention illustrating the relationship of the carton sides and the inner wall 16, overlapping wall 20, and outer wall 24. In the particular embodiment shown in FIG. 3, tuck-in flap 56 is hingedly connected to top side 44 at hinge line 58 and is folded inwardly about score line 58 to form a seal for the top edge of the carton. Inner wall 16 is integrally formed with and hingedly attached to front side 38 by means of score line 60. After flap 56 has been folded inwardly about score line 58, inner wall 16 is folded inwardly about score line 60 to overlap flap 56.

Overlapping wall 20 is hingedly attached by panel 66 to back side 42 by means of score line 62. After inner wall 16 is folded inwardly about score line 60, overlapping wall 20 is folded inwardly about fold line 62 and thus overlaps inner wall 16. By pressing on the center of projection 22, it bends about score line 34 and forms a V-shaped projection which enters orifice 18 in inner wall 16 to form an insert or projection extending within the hollow core containing product kept in the carton. When the V-shaped projection 22 is extended a sufficient distance into orifice 18 of inner wall 16, locking tab 28 on projection 22 engages slotted detent 26 of orifice 18 and, because of shoulders 64 on projection 22 adjacent the base of lock tab 28, the projection 22 is loced into pace by slotted detent 26.

At that point, outer wall 24, which is integrally formed with the carton bottom side 40 and hingedly attached thereto by means of score line 52, is folded upwardly about score line 52 and, with glue applied to adhesive strip 68, outer wall 24 is attached to the upper portion of panel 66 of overlapping wall 20 and the remaining exposed portion of inner wall 16.

Top side 44 has an extension 70 integrally formed therewith and hingedly attached thereto by means of score line 72. With the end walls folded as previously indicated and the product within the carton, extension 70 is folded downwardly over the front side 38 of the carton about fold line 72 and attached thereto by means of glue applied to the adhesive strip 74. A tear strip 76 is utilized to open the carton when necessary to remove the product. This tear strip is removed from extension 70 leaving the lower portion thereof glued to front side 38 but allowing the upper portion 48 thereof to be free. Thus the carton can then be opened and the contents removed from the roll without the roll coming out of the carton because it is held in place by means of projection 22 which, in its V-shape, is extending through orifice 18 of inner wall 16 into the interior of the hollow core containing the product.

Figure 4:
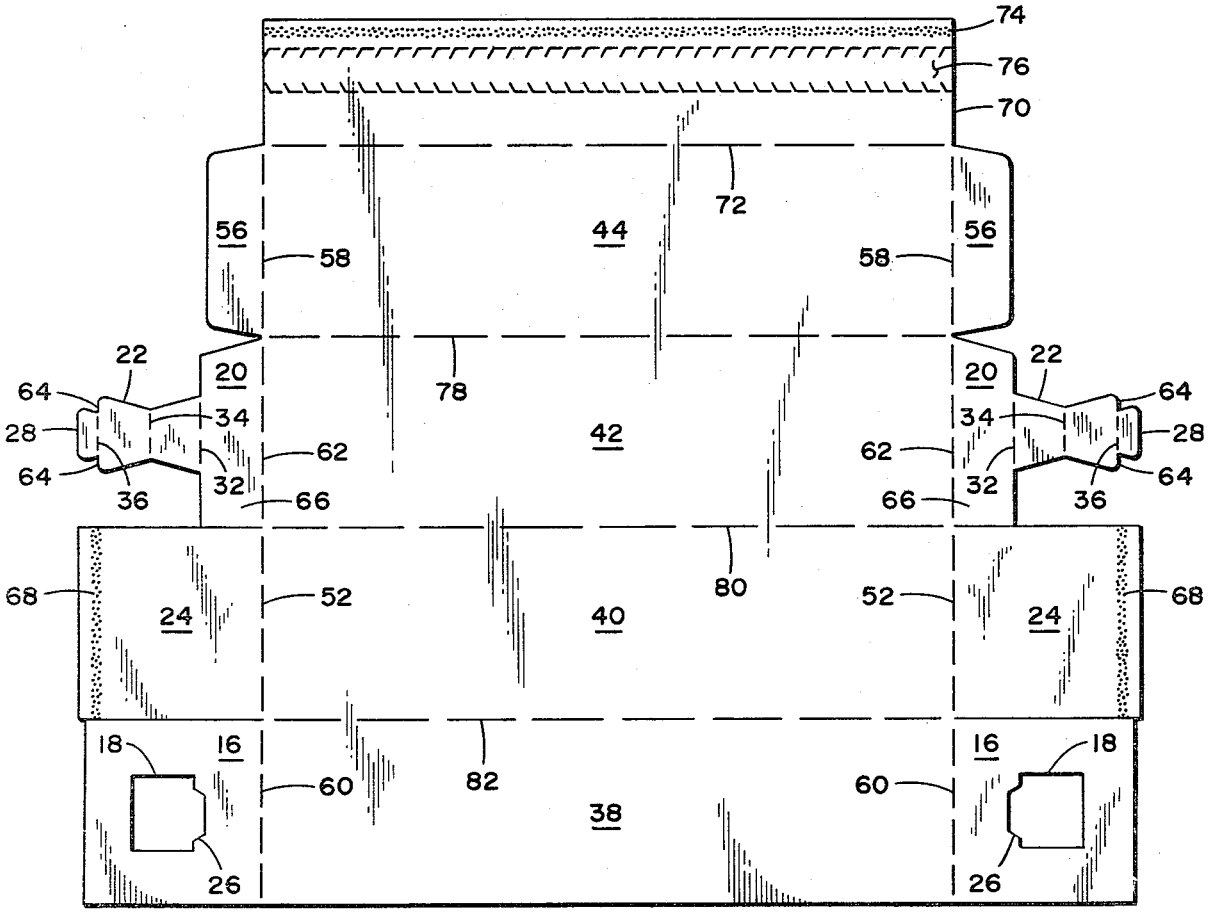
FIG. 4 is a plan view of a blank for forming the carton illustrated in FIG. 3.

A blank for forming the carton illustrated in FIG. 3 is shown in FIG. 4. As can be seen in FIG. 4, the blank includes front side 38, bottom side 40, back side 42, and top side 44 all integrally formed and hingedly connected to each other by means of score lines 82, 80 and 78 respectively. Integrally formed with and hingedly attached to each end of front side 38 by means of score lines 60 is an inner panel 16 having therein an orifice 18 with a slotted detent 26. As stated earlier, when the carton is folded, tubed and erected, inner wall 16 is folded inwardly about score lines 60. A tuck-in flap 56 is integrally formed with and hingedly attached to each end of top side 44 by means of score lines 58 and it is these tuck-in flaps 56 which are first folded inwardly about score lines 58 immediately preceding the folding inwardly of inner wall 16 about score lines 60. If desired, flap 56 could be folded inwardly about score line 58 after inner wall 16 has been folded inwardly or after overlapping wall 20 has been folded inwardly.

Integrally formed with and attached at each end of back side 42 by means of score lines 62 are overlapping walls 20, each of which comprise a panel 66 and projection 22 hingedly attached thereto by means of score line 32. The projection also has a score line 34 thereon by which the projection can be folded about score line 34 to form a V-shaped projection. Locking tab 28 is formed on the outer end of each projection 22 and is of such a size with relation to projection 22 that shoulders 64 are formed on each side of locking tab 28 for engaging slotted detent 26 of inner wall 16 when the carton is erected. Thus, projection 22 is folded about score line 34 to form a V-shaped projection which extends through orifice 18 of inner wall 16 when the carton is erected and extends inside the hollow core containing the product in the carton. Locking tab 28 rests in slotted detent 26 with the shoulders 64 caught thereunder thereby holding the V-shaped projection 22 inside the carton.

Outer wall 24 is integrally formed with each end of bottom side 40 by means of score line 52 and is folded as shown in FIG. 3 upwardly about score lines 52 when the carton is erected to cover the outer end of the carton. Glue or adhesive strip 68 is used to attach outer wall 24 to the exposed portion of panel 66 of overlapping wall 20 and the exposed portion of inner wall 16. Thus the ends of the carton are sealed and the V-shaped projection 22 held in place. As best seen in FIG. 1, locking tab 28 is folded about score line 36 to allow outer wall 24 to closely adhere to overlapping wall 20 and inner wall 16.

Integrally formed with and hingedly attached to the remaining edge 72 of top side 44 is an extension 70. Glue strip 74 is formed thereon and tear strip 76 is formed therein. When the carton is folded, tubed and erected, extension 70 overlaps front side 38 and is attached thereto by means of glue on adhesive strip 74. When it is desired to open the carton, tear strip 76 is removed thus leaving that portion of extension 70 with the glue strip 74 thereon attached to the front side 38 and the remaining portion of extension 70 is free thus allowing the carton to be opened.

Figure 5:
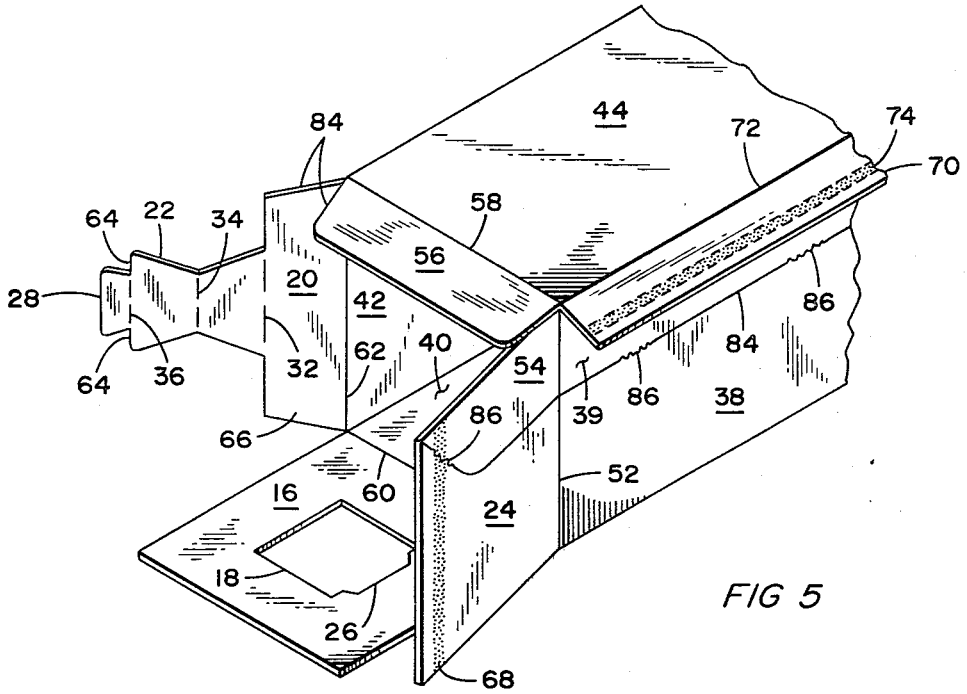
FIG. 5 is a partial perspective view of one end of a carton illustrating an alternate embodiment of the present invention and disclosing the relationship of the walls which form the end of the novel carton.

FIG. 5 is a partial perspective view of a carton of the present invention illustrating an alternate embodiment of the construction of the carton end wall and the relationship of its components. Thus, in this embodiment, which is the same embodiment illustrated in FIG. 2, inner wall 16 is integrally formed with and hingedly connected to bottom side 40 by means of score line 60. Again, inner wall 16 includes orifice 18 which has slotted detent 26 therein. In this particular embodiment, inner wall 16 is first folded upwardly about score line 60 when the carton is folded, tubed and erected. Secondly, flap 56 which is integrally formed with and hingedly attached to top side 44 by score line 58 it is folded downwardly, overlapping the upper portion of inner wall 16. After panel 56 has been folded downwardly about score line 58 to overlap the upper portion of inner wall 16, overlapping wall 20, which is integrally formed with and hingedly attached to back side 42 by means of score line 62, is folded inwardly about score line 62 to overlap inner wall 16. Both panel 56, which is integrally formed with top side 44, and panel 66, which forms a part of overlapping wall 20, have tapered corners 84 which meet in an abutting relationship when overlapping wall 20 is folded inwardly about score line 62. Again, as explained previously, projection 22 is bent inwardly about score line 34 to form a V-shaped projection which extends through orifice 18 located in inner wall 16 and is then located inside the hollow core containing the product within the carton. Also, as explained earlier, locking tab 28 is mated with slotted detent 26 with shoulders 64 caught under detent 26 thus holding the projection 22 within the hollow core containing the product inside the carton.

Outer wall 24, which is integrally formed with and hingedly attached to front side 38 by means of score line 52, is folded inwardly about score line 52 to cover inner wall 16, overlapping wall 20 and flap 56. Adhesive strip 68 is located on the inside of outer wall 24 and causes outer wall 24 to adhere to panel 66 of overlapping wall 20 and panel 56 attached to top side 44. Thus the end of carton is sealed by outer wall 24. It will be noted that front side 38 is divided into two sections by a slit 84 and tear strips 86. This slit 84 extends onto outer wall 24 which has tear strips 86 thereon also. When the carton is folded, tubed and erected, extension 70 which is integrally formed with and hingedly attached to top side 44 by means of score line 72, is folded downwardly and glue strip 74 adheres extension 70 to the upper portion of front side 38. When it is desired to open the carton, pressure is applied to tear strips 86 which separate and top side 44 including extension 70, the upper portion of front side 38 and the upper portion 87 of end wall 24 all lift upwardly to enable the carton to be opened.

Figure 6:
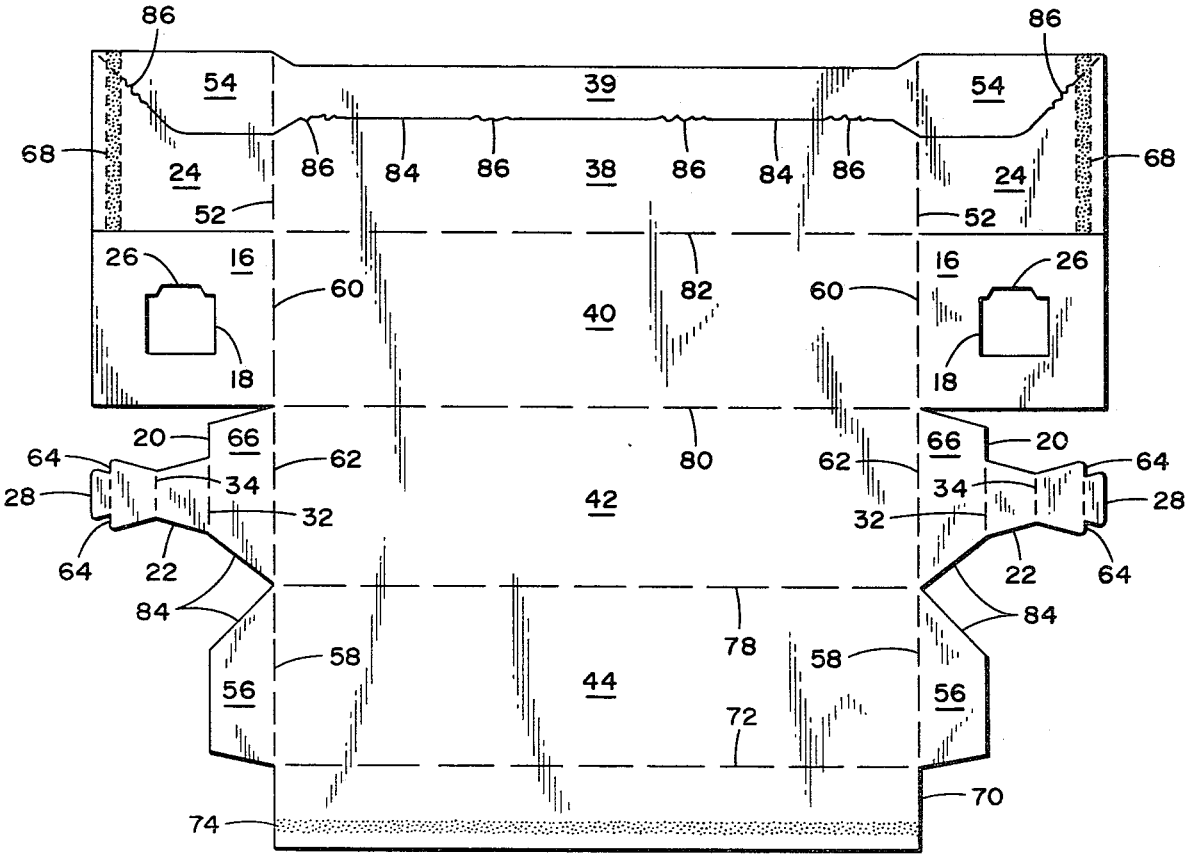
FIG. 6 is a plan view of a blank for forming the novel alternate embodiment disclosed in FIG. 5.

A blank for forming the carton of the embodiment shown in FIG. 5 is disclosed in FIG. 6. Again, front side 38, bottom side 40, back side 42, and top side 44 are integrally formed and hingedly attached to each other by means of score lines 78, 80 and 82. Also integrally formed with and hingedly attached to the outer edge of top side 44 by means of score line 72 is an extension panel 70. Extension panel 70 has a glue strip 74 thereon for fastening said extension to the front side 38 of said carton. Bottom side 40 of the carton has integrally formed with and hingedly attached to each end thereof by score lines 60, an inner wall 16. As in the previous embodiment, inner wall 16 has therein orifice 18 which has a slotted detent 26 formed as a part thereof. When the carton is folded, tubed and erected, inner wall 16 is folded upwardly about score line 60 on each end of bottom side 40.

Back side 42 has integrally formed therewith and hingedly attached to each end thereof by means of score lines 62, an overlapping wall 20 which includes panel 66 and a projection 22. Projection 22 is hingedly attached at score line 32 to panel 66 and has a score line 34 thereon by which the projection 22 can be bent about score line 34 thus forming a V-shaped projection which, when the carton is folded, tubed and erected, extends through orifice 18 in inner wall 16 because overlapping wall 20 is folded upwardly about score line 62 and overlaps inner wall 16. Thus the V-shaped projection 22 extends not only through orifice 18 in inner wall 16 but also extends inside the hollow core containing the product in the carton. Thus the core is retained within the carton. Locking tab 28 is mated with slotted detent 26 in orifice 18 and the shoulders 64 of projection 22 lie under detent 26 thus locking projection 22 in place inside the carton. Flap 56 which is integrally formed with and hingedly attached to top side 44 by means of score line 58, is folded upwardly about score line 58 and, when the carton is folded, tubed and erected, slanted edge 84 of flap 56 mates with slanted edge 84 of panel 66 on overlapping wall 20.

Outer wall 24 is integrally formed with and hingedly attached to each end of front side 38 by means of score lines 52. When the carton has been folded, tubed and erected, outer wall 24 is folded upwardly about score line 52 and covers inner wall 16, overlapping wall 20, and flap 56. Because each end wall 24 has thereon a glue strip 68, the end wall 24 is securely attached to panel 66 of overlapping wall 20 and a portion of flap 56. Thus the end of the carton is sealed. Further, extension 70 is folded about score line 72 to overlap a portion of front side 38. Glue strip 74 on extension 70 is glued to that portion 39 of front panel 38 above slit 84. The carton is thus sealed. When it is desired to utilize the contents of the carton, pressure is applied to tear strips 86 which separate front side 38 into two parts. In addition, the tear strips 86 are extended to and also separate outer wall 24 and, since extension 70 is glued to the upper portion of front side 38, the entire top side 44, extension 70, the upper portion 39 of front side 38 and the upper portion 54 of outer wall 24 are lifted up to open the carton.

Figure 7:
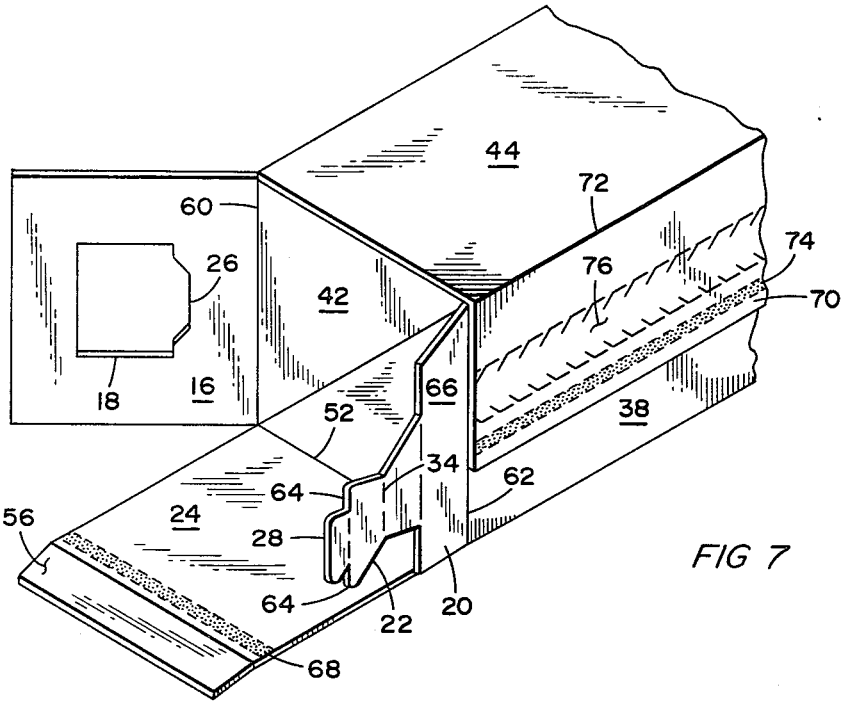
FIG. 7 is a partial perspective view of an end of a second alternate embodiment of the present invention illustrating the relationship of the walls which form the ends of the novel carton.

FIG. 7 is a partial perspective view of a second alternate embodiment of the end construction of a carton having a core retainer formed in the end wall of the carton. In this embodiment, inner wall 16 is integrally formed with and hingedly attached to back side 42 by score line 60. Again, inner wall 16 has orifice 18 therein with slotted detent 26 formed as part of orifice 18. In this embodiment, inner wall 16 is folded inwardly about score line 60 as the first step in closing the end of the carton and forming the end wall. Next, overlapping wall 20, which is integrally formed with and hingedly attached to front side 38 by score line 62, is folded inwardly about score line 62 to overlap inner wall 16. By bending projection 22 inwardly about score line 34 and score line 32, projection 22 forms a V-shaped projection which passes through orifice 18 in inner wall 16 and penetrates the hollow core containing the product held by the container. Thus the product and the hollow core are retained in the carton by means of V-shaped projection 22 being located within the hollow core. Shoulders 64 rest under slotted detent 26 in inner wall 16 and locking tab 28 rests in the slotted detent thus holding V-shaped projection 22 in place inside the hollow core. To finish closing the end wall, outer wall 24 is folded upwardly about score line 52 to cover overlapping wall 20 and inner wall 16. Glue strip 68 on the inner surface of outer wall 24 attaches outer wall 24 to a portion of panel 66 on overlapping wall 20 and a portion of inner wall 16. Flap 56 on outer wall 24 is folded about score line 58 to form a tuck-in flap under top side 44 to finish sealing the carton end wall.

Extension 70 is integrally formed with and hingedly attached to top side 44 by score lines 72. By folding extension 70 over front side 38, it can be attached to front side 38 by means of glue strip 74. In order to open the carton, tear strip 76 is physically removed thus releasing the upper portion of extension 70 which is hingedly attached to top side 44 and the carton can then be opened.

Figure 8:
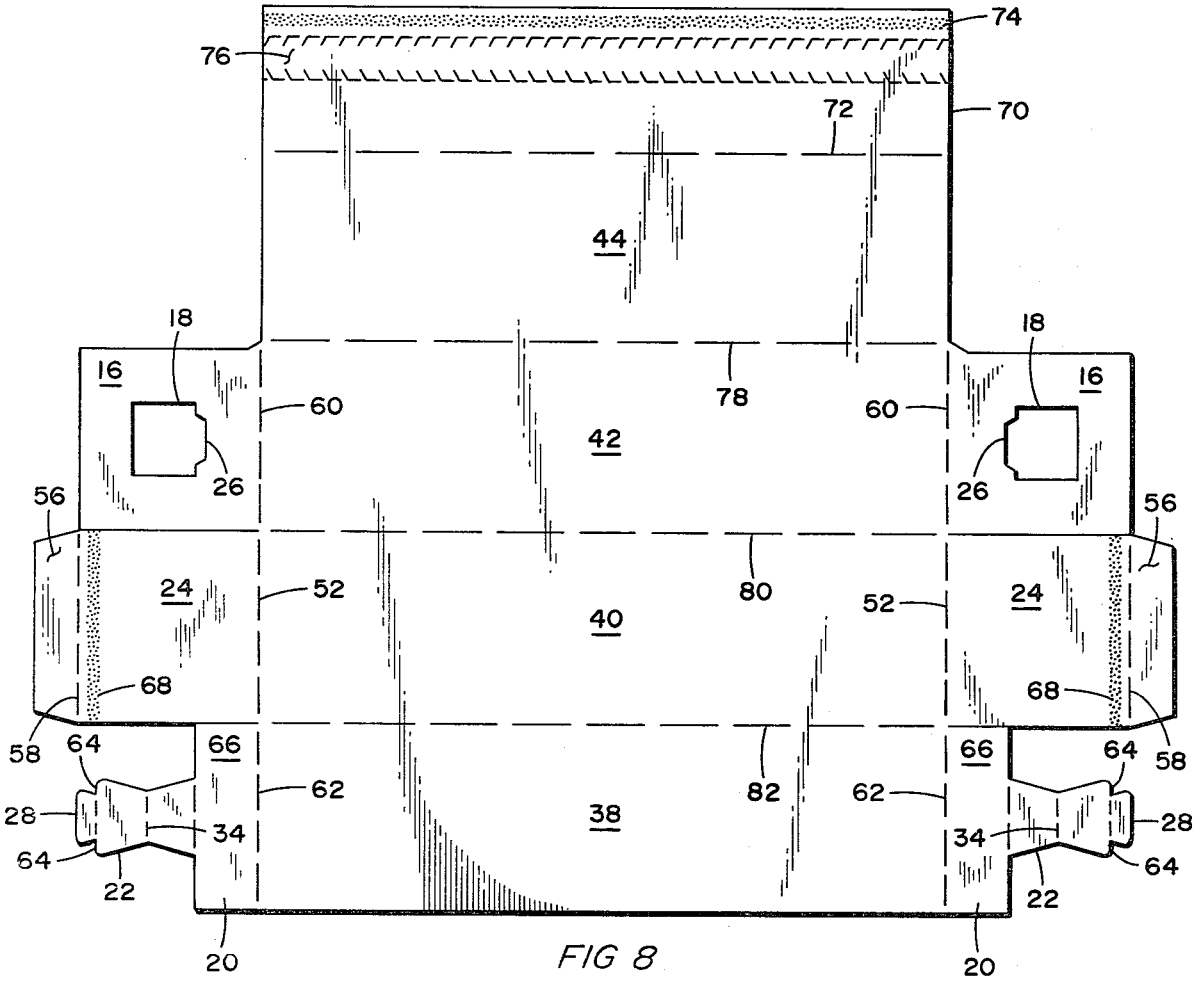
FIG. 8 is a plan view of a blank for forming the novel carton illustrated in FIG. 7.

FIG. 8 is a plan view of a blank from which the carton of FIG. 7 may be constructed. Again, front side 38, bottom side 40, back side 42 and top side 44 are integrally formed with and hingedly connected to each other by means of score lines 78, 80 and 82. An extension panel 70 is integrally formed with and hingedly connected to the other edge of top side 44 by means of score line 72. When the carton blank is folded, tubed and erected, the end walls may then be formed. First, as explained with reference to FIG. 7, inner wall 16 is folded inwardly about score line 60. Next, overlapping wall 22 is folded inwardly about score line 62 and as described with respect to the embodiments shown in FIG. 3 and FIG. 5, projection 22 is bent about score line 34 to form a V-shaped projection which is inserted through orifice 18 in inner wall panel 16 to penetrate the inside of the hollow core containing the product within the carton. Again, locking tab 28 is engaged with slotted detent 26 and shoulders 64 of projection 22 are caught under the edges of slotted detent 26 to lock the V-shaped projection 22 in place. Outer wall 24 is then folded inwardly about score line 52 and glue strip 68 attaches outer wall 24 to a portion of panel 66 on overlapping wall 20 and a portion of inner wall 16. Tuck-in flap 56 folds inwardly about score line 58 and is inserted under top side 44 to complete closing the end of the carton.

Extension 70 is folded over front side 38 about score line 72 and attached to front side 38 by means of glue strip 74. When it is desired to open the carton, tear strip 76 is removed physically thus freeing the remainder of extension 70 and top side 44.

Thus there has been disclosed a carton which has core retainers integrally formed with the end walls of the carton which are inserted inside the hollow core as the carton is erected thus retaining the core within the carton as the product is unrolled therefrom.

While the invention has been described in connection with a preferred embodiment, it is not intended to limit the scope of the invention to the particular form set forth, but on the contrary, it is intended to cover such alternatives, modifications, and equivalents as may be included with the spirit and scope of the invention as defined by the appended claims.

What is claimed is:

1. In a carton having at least three sides and end walls for containing a product on a hollow core, at least one carton end wall forming a core retainer comprising:

a. an inner wall coupled to a first side of said carton and having an orifice therein, said inner wall including means adjacent said orifice defining a slotted detent, b. an overlapping wall coupled to a second side of said carton and having a projection thereon extending through said orifice into said hollow core whereby said core is held in said carton, said overlapping wall including a panel having one side coupled to said second side of said carton, a projection hingedly coupled to the other side of said panel, a fold line in said projection allowing said projection to bend about said fold line and form a V-shaped insert pointedly extending into said hollow core, and locking means including a locking tab hingedly connected to the outer end of said projection for engaging said slotted detent means in said inner wall thereby locking said V-shaped insert within said hollow core, and c. an outer wall coupled to a third side of said carton for closing the end of said carton, said outer wall overlying a portion of said projection and said locking tab.

2. A carton as in claim 1 wherein both end walls form core retainers.

3. A carton as in claim 1 wherein said carton has top and bottom sides and front and back sides.

4. A carton as in claim 3 wherein:

a. said inner wall is coupled to said carton front side, b. said overlapping wall is coupled to said carton back side, and c. said outer wall is coupled to said carton bottom side.

5. A carton as in claim 3 wherein:

a. said inner wall is coupled to said carton bottom side, b. said overlapping wall is coupled to said carton back side, and c. said outer wall is coupled to said carton front side.

6. A carton as in claim 3 wherein:

a. said inner wall is coupled to said carton back side, b. said overlapping wall is coupled to said carton front side, and c. said outer wall is coupled to said carton bottom side.

7. A carton as in claims 4, 5 or 6 further including:

a. a panel extension coupled with the front edge of said top side, and b. means removably attaching said panel extension to said carton front side whereby said carton may be opened to remove said product from said hollow core by rotating said core.

8. A carton as in claims 4, 5 or 6 further including a glue strip on one inner edge of said outer wall whereby said outer wall is glued to an opposing panel attached to the opposite carton side thereby sealing the end of said carton.

9. A carton as in claim 1 wherein said outer wall is adhesively connected to said inner wall only.

10. A carton blank for forming a carton having a core a. top, bottom, front and back side panels integrally formed with and hingedly attached to each other, b. an inner wall panel having an orifice therein hingedly connected to each end of one of said side panels, said inner wall panel orifice including a slotted detent, c. an overlapping wall panel having a projection thereon and hingedly connected to each end of a second one of said side panels, each of said overlapping wall projections including:

(1) a panel having one side hingedly coupled to said second one of said side panels, (2) a projection hingedly coupled to the other side of said hinged panel, (3) a fold line in said projection allowing said projection to bend about said fold line and form a V-shaped insert for extending into a hollow core contained in said completed carton, and (4) a locking tab hingedly attached to the outer end of said projection for engaging said slotted detent when said carton is completed, and d. an outer wall panel connected to each end of a third one of said side panels whereby when said blank is tubed, folded and erected with a product on a hollow core contained therein, said inner wall, overlapping wall, and outer wall on each end form an end wall of said carton with said projection retaining said core in said carton.

11. A carton blank as in claim 10 wherein:

a. said inner wall is coupled to said front side panel, b. said overlapping wall is coupled to said back side panel, and c. said outer wall is coupled to said bottom side panel.

12. A carton blank as in claim 10 wherein:

a. said inner wall is coupled to said bottom side panel, b. said overlapping wall is coupled to said back side panel, and c. said outer wall is coupled to said front side panel.

13. A carton blank as in claim 10 wherein:

a. said inner wall is coupled to said back side panel, b. said overlapping wall is coupled to said front side panel, and c. said outer wall is coupled to said bottom side panel.

14. A carton blank as in claims 11, 12 or 13 further including:

a. a panel extension hingedly coupled to the remaining edge of said top side panel, and b. a tear strip inserted longitudinally in said panel extension dividing said extension into two parts whereby when said carton is completely folded, said extension may be fixedly attached to said front side panel by one part and said tear strip removed to allow opening of said carton with said other part.

15. A carton blank as in claims 11, 12 or 13 further including a glue strip on one inner edge of said outer wall whereby, when said carton is completely folded, said outer wall is glued to an opposing panel attached to the opposite carton side thereby sealing the end of said carton.

* * * * *